US007350486B1

(12) United States Patent
Wu et al.

(10) Patent No.: US 7,350,486 B1
(45) Date of Patent: Apr. 1, 2008

(54) VARIABLE VALVE ACTUATION MECHANISM

(75) Inventors: Min-Chuan Wu, Taipei County (TW); Ta-Chuan Liu, Taipei (TW)

(73) Assignee: Industrial Technology Research Institute, Hsin-Chu (TW)

( * ) Notice: Subject to any disclaimer, the term of this patent is extended or adjusted under 35 U.S.C. 154(b) by 0 days.

(21) Appl. No.: 11/563,455

(22) Filed: Nov. 27, 2006

(30) Foreign Application Priority Data

Nov. 3, 2006 (TW) ..... 95140651 A

(51) Int. Cl.
*F01L 1/34* (2006.01)

(52) U.S. Cl. ..... 123/90.16; 123/90.48; 123/90.15; 123/90.59

(58) Field of Classification Search ..... 123/90.16, 123/90.48, 90.15, 90.59, 90.5
See application file for complete search history.

(56) References Cited

U.S. PATENT DOCUMENTS 5,287,830 A 2/1994 Dopson et al.
5,343,833 A 9/1994 Shirai
5,351,662 A 10/1994 Dopson et al.
5,361,733 A 11/1994 Spath et al.
5,431,133 A 7/1995 Spath et al.
5,651,335 A * 7/1997 Elendt et al. ..... 123/90.16
5,694,894 A 12/1997 Allen
5,709,180 A 1/1998 Spath
5,743,226 A * 4/1998 Tohdoh et al. ..... 123/90.16
5,782,216 A 7/1998 Haas et al.
5,950,583 A 9/1999 Kraxner et al.
6,053,133 A 4/2000 Faria et al.
6,076,491 A 6/2000 Allen
6,135,074 A 10/2000 Kuhl
6,223,706 B1 5/2001 Maas et al.
6,397,804 B1 6/2002 Harada et al.
6,588,386 B2 7/2003 Kong
6,805,084 B2 10/2004 Artmann
6,854,432 B2 2/2005 Hirano
6,857,406 B2 2/2005 Matsuura et al.

* cited by examiner

*Primary Examiner*—Zelalem Eshete
(74) *Attorney, Agent, or Firm*—WPAT, P.C.; Justin I. King

(57) ABSTRACT

The present invention discloses a variable valve actuation mechanism, characterized in that movement of a sliding block is controlled for selectively receiving a driving force exerted from an actuating mechanism so as to control lift, such as higher or lower lift, of valves disposed in a combustion engine. With the design disclosed in the present invention, a conventional problem due to misalignment of the channel for locking pin sliding during changing lift of valve is capable of being solved. In the preferred embodiment of the present invention, actuating parts for controlling higher valve lift will not contact with the variable valve actuation mechanism while the valve is under lower lift so that the combustion engine will be operated in an appropriate rotation speed efficiently so as to reduce fuel consumption.

17 Claims, 15 Drawing Sheets

VARIABLE VALVE ACTUATION MECHANISM

FIELD OF THE INVENTION

The present invention relates to a valve actuation mechanism, and more particularly, to a variable valve actuation mechanism capable of using the movement of a sliding block for selecting a driving force exerted from an actuating part thereof and thus controlling lift of valves disposed in a combustion engine with respect to the action of the selected driving force.

BACKGROUND OF THE INVENTION

With the ever-increasing oil price, fuel economic efficiency and fuel-saving potentials of an engine are becoming more and more important. Recently, most fuel-saving researches are focused upon developing variable valve actuation mechanism since it is the foundation of various fuel-saving techniques, such as cylinder deactivation, engine down-sizing, and so on.

Currently, there are various researches relates to valve lift control. One such research is disclosed in U.S. Pat. No. 6,223,706 B1, as that illustrated in FIG. 1. As seen in FIG. 1, the variable valve actuation mechanism 1 is basically a hollow outer annular part 10 concentrically enclosing an inner annular part 11, whereas the two parts 10, 11 are axially movable relative to each other. Cams of different lift (not shown) are arranged for enabling the same to have contact with the outer and inner annular parts 10, 11 in respective, and the switching between different valve lifts is controlled by a locking means. The locking means is comprised of three slides 12, 13, 14, which are arranged and extending in receptions 101, 102, 103 respectively formed in the outer and inner annular parts 10, 11, and are capable being forced by a hydraulic means and inset into recesses of the outer and inner annular parts 10, 11 in respective for separating or coupling the two annular parts 10, 11.

As the three slides 12, 13, 14 are held at a specific position by the resilience of a spring 15,17 as seen in FIG. 1, the outer and the inner annular parts 10, 11 are separated. However, while intending to couple the two annular parts 10, 11, the hydraulic means is activated for pushing the slide 14 and thus forcing the same to enter the reception 102 of the inner annular part 11. Therefore, by the separating/coupling of the two annular parts 10, 11, various valve lifts can be enabled. However, it is noted that if the three slides 12, 13, 14 are not perfectly aligned and thus the slide 14 can be pushed to enter the reception 102 accurately and smoothly, the switching of valve lift will fail.

In addition, when a low lift is selected and the low-lift cam is pressing upon the inner annular part 11 for thus actuating the corresponding valves of an engine, the high-lift cam that is not selected will still press upon the outer annular part 10. Although the displacement of the outer annular part 10 is absorbed by a spring 16 arranged inside the outer annular part 10, it will still have affect upon the valves of low loft whenever there is a situation that the spring 16 is poorly designed or a force is maintained upon the spring 16 while the high-lift cam is pressing upon the outer annular part 10.

Therefore, it is in need of a variable valve actuation mechanism that can free from aforesaid drawbacks.

SUMMARY OF THE INVENTION

In view of the disadvantages of prior art, the primary object of the present invention is to provide a variable valve actuation mechanism capable of using the movement of a sliding block for valve lift control, by which the aforementioned failure of switching between low and high lifts is eliminated.

It is another object of the invention to provide a variable valve actuation mechanism capable of using the movement of a sliding block for selecting a driving force exerted from an actuating part thereof and thus controlling lift of valves disposed in a combustion engine with respect to the action of the selected driving force, by which the fuel efficiency of the combustion engine is improved and thus the fuel consumption is reduced.

Yet, another object of the invention to provide a variable valve actuation mechanism capable of using the movement of a sliding block for enabling valves of a combustion engine to free from the affection the actuating parts of the variable valve actuation mechanism, by which the cylinder of the engine can be deactivated and thus the fuel consumption is reduced.

To achieve the above objects, the present invention provide a variable valve actuation mechanism, comprising: a tappet, having an accommodation space formed therein; a sliding block, arranged inside the accommodation space; and a driving apparatus, for driving the sliding block to slide inside the accommodation space and thus enabling a part selected from the group consisting of the tappet and the sliding block to be selected for receiving a driving force and moved accordingly.

In another preferred embodiment of the invention, the present invention further provide a variable valve actuation mechanism, comprising: a tappet, having an accommodation space formed therein; a sliding block, arranged inside the accommodation space; and a driving apparatus, for driving the sliding block to slide inside the accommodation space and positioning the same at a position selected from a first position and a second position, where the sliding block is enabled to receive a driving force at the selected position of the driving apparatus and moved accordingly.

Preferably, the sliding block further comprises: at least a first groove hole, formed at a side of the sliding block; at least a first hydraulic pressure sleeve, each being fitted inside the at least one first groove hole while enabling an end thereof to be fixedly connected to the tappet for enabling the sliding block to move slidably with respect to the first hydraulic pressure sleeve; at least a second groove hole, formed at a side of the sliding block other than that of the first groove hole; and at least a second hydraulic pressure sleeve, each being fitted inside the at least one second groove hole while enabling an end thereof to be fixedly connected to the tappet for enabling the sliding block to move slidably with respect to the second hydraulic pressure sleeve. With which, the driving apparatus, being a hydraulic pressure supplier, is connected respectively to the at least one first and second hydraulic pressure sleeves for enabling the same to provide a hydraulic pressure to a part selected from the group consisting of the at least one first hydraulic pressure sleeve and the at least one second hydraulic pressure sleeve, and thus enabling the selected part to be used for forcing the sliding block to move accordingly.

Preferably, the sliding block further comprises: at least a first groove hole, formed at a side of the sliding block; at least a first hydraulic pressure sleeve, each being fitted inside the at least one first groove hole while enabling an end thereof to be fixedly connected to the tappet for enabling the sliding block to move slidably with respect to the first hydraulic pressure sleeve. With which, the driving apparatus is further comprised of: a hydraulic part, connected to the at least first hydraulic pressure sleeve for providing a hydraulic pressure to the first hydraulic pressure sleeve and thereby forcing the sliding block to move accordingly; and at least an elastic member, each being arranged for enabling an end thereof to abut against a side of the sliding block other than that of the first groove hole while enabling another end thereof to abut against a wall of the tappet.

In another preferred aspect, the sliding block further comprises: at least a first groove hole, formed at a side of the sliding block; at least a first hydraulic pressure sleeve, each being fitted inside the at least one first groove hole while enabling an end thereof to be fixedly connected to the tappet for enabling the sliding block to move slidably with respect to the first hydraulic pressure sleeve; and at least a via hole, boring through the sliding block. With which, the driving apparatus is further comprised of: a hydraulic part, connected to the at least first hydraulic pressure sleeve for providing a hydraulic pressure to the first hydraulic pressure sleeve and thereby forcing the sliding block to move accordingly; at least an elastic member, each being arranged for enabling an end thereof to abut against a side of the sliding block other than that of the first groove hole while enabling another end thereof to abut against a wall of the tappet; and at least a limiting shaft, each being surrounded by the at least one elastic member and extending passing through the at least one via hole while enabling the two ends thereof to fixedly connected to two different walls of the tappet in respective. Preferably, a protruding part is extendedly formed at an end of the at least one limiting shaft while bulging outside the tappet.

Preferably, a knot, substantially a column-like roller, is formed on the outer wall of the tappet.

Preferably, at least a shim is disposed on a bottom of the tappet, each being placed at a position corresponding to a valve of an engine.

Preferably, a first contacting surface is arranged at a top of the tappet while a second contacting surface is arranged at a top of the sliding block. In a preferred aspect, the driving apparatus is able to selectively drive the sliding block to move to a position selected from the group consisting of: the position enabling the second contacting surface to be located under the first contacting surface so as to enable the driving force to be received by the first contacting surface, and any position enabling the driving force to be received by the second contacting surface directly.

Preferably, the driving force is provided by an actuating part, which can be a cam set.

Other aspects and advantages of the present invention will become apparent from the following detailed description, taken in conjunction with the accompanying drawings, illustrating by way of example the principles of the present invention.

DESCRIPTION OF THE PREFERRED EMBODIMENT

For your esteemed members of reviewing committee to further understand and recognize the fulfilled functions and structural characteristics of the invention, several preferable embodiments cooperating with detailed description are presented as the follows.

Figure 1:
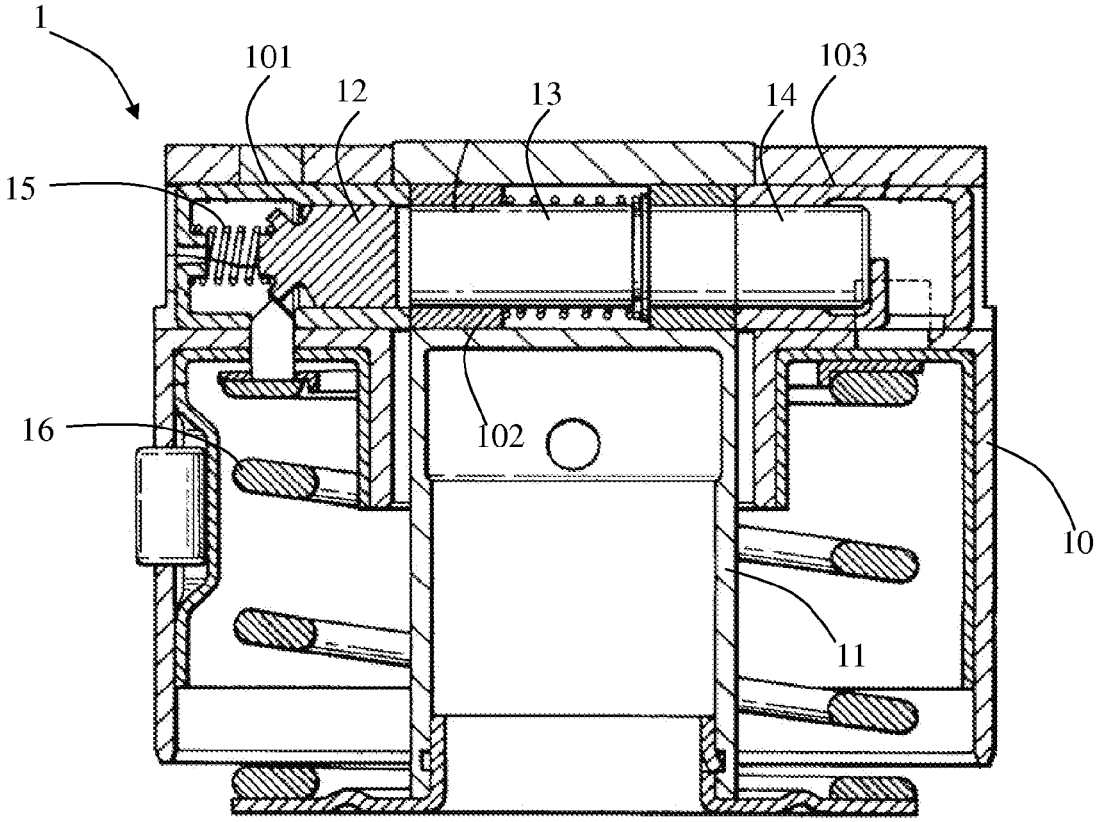
FIG.1 (Prior Art)
FIG. 1 is a prior-art variable valve actuation mechanism disclosed in U.S. Pat. No. 6,223,706 B1.
Figure 2:
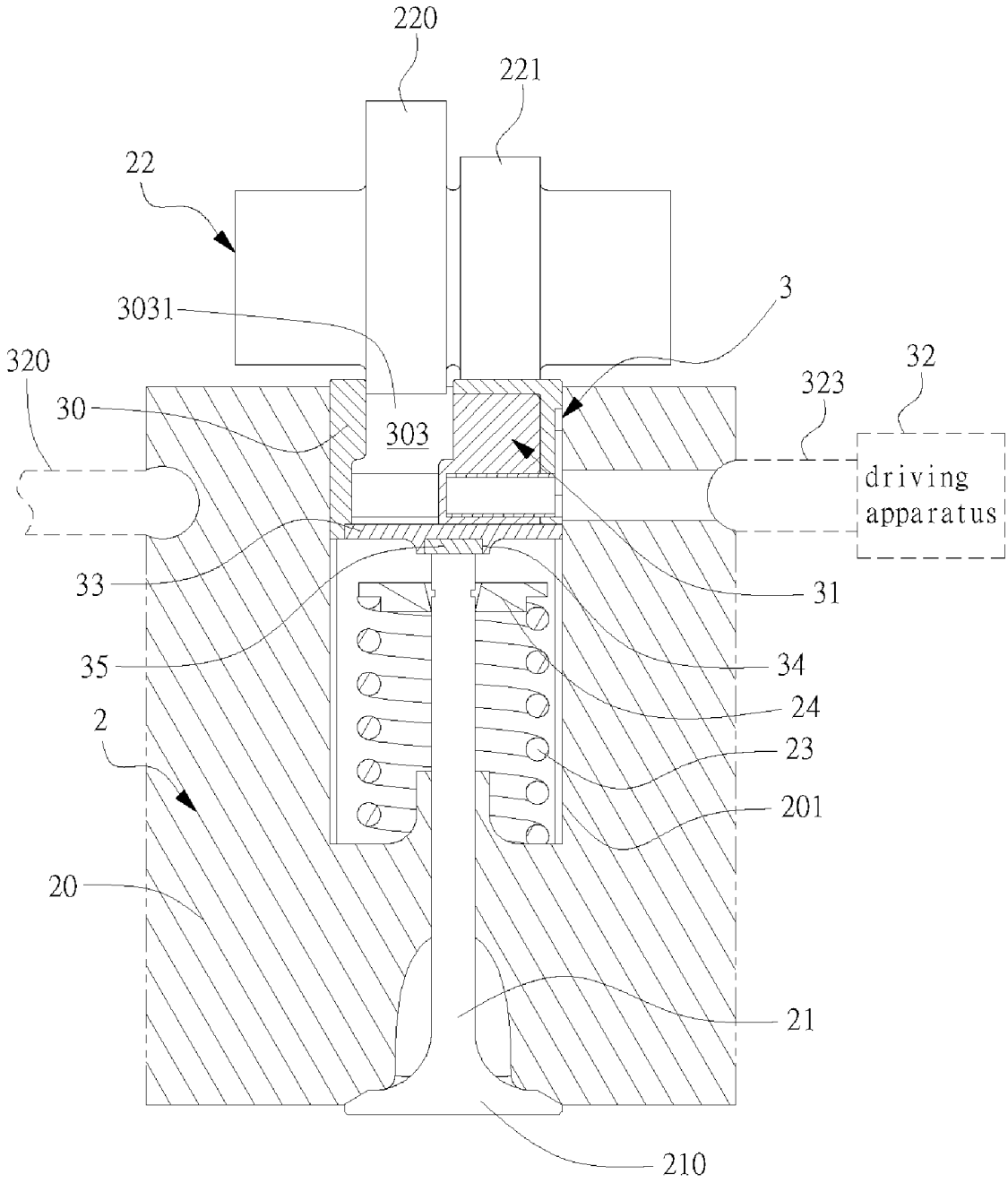
FIG. 2 is a cross-sectional diagram illustrating a variable valve actuation mechanism according to a first preferred embodiment of the invention as it is coupled to an engine.

Please refer to FIG. 2, which is a cross-sectional diagram illustrating a variable valve actuation mechanism according to a first preferred embodiment of the invention as it is coupled to an engine. The variable valve actuation mechanism 3, driven by an actuating part 22, is used for controlling the valve lift of the engine, which comprises: a tappet 30, a sliding clock 31 and a driving apparatus 32. The tappet 30 is arranged to fit inside a cylinder head 20 of an engine 2 while being positioned to abut against a valve lever 21, in which an accommodation space 303 with an opening 3031 is formed. The sliding block 31 is being arranged inside the accommodation space 303. The driving apparatus 32 is used for driving the sliding block 31 to slide inside the accommodation space 303 and thus enabling a part selected from the group consisting of the tappet 30 and the sliding block 31 to be selected for receiving a driving force provided from the actuating part 22 and moved accordingly. In this preferred embodiment, the driving apparatus is substantially a hydraulic pressure supplier, that is connected to the variable valve actuation mechanism 3 by the hydraulic pressure pipings 320 and 323.

As seen in FIG. 2, the tappet is enabled to move up and down a cylinder pit 201 while it is positioned under a cam set acting as the actuating part 22, that the cam set is composed of a high-lift cam 220 and a low-lift cam 221, both capable of pressing upon the variable valve actuation mechanism 3 for enabling the engine with different valve lifts. As the bottom of the tappet 30 is in contact with the top of the valve lever 21, the tappet 30 will press the valve lever 21 and thus activate a corresponding valve 210 when the tappet 30 is pressed by the actuating part 22. Moreover, when the tappet 30 is not subjecting to the pressing of the actuating part 22, the compressed valve spring 23 will exert a force upon the valve spring retainer 24 to push the same to move upwardly and thus enable the valve 210 to close.

Figure 3A:
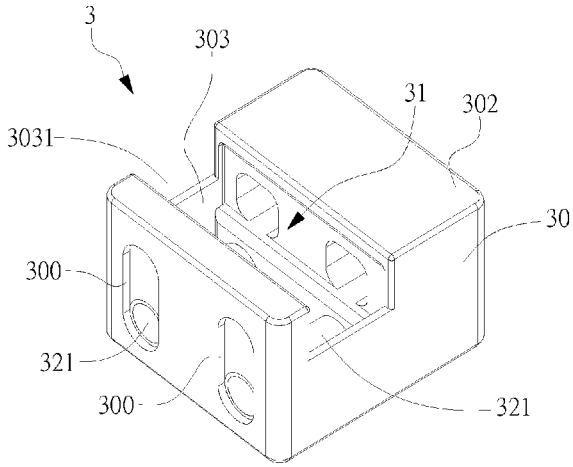
FIG. 3A and FIG. 3B are three-dimensional views of the variable valve actuation mechanism of FIG. 2.
Figure 3B:
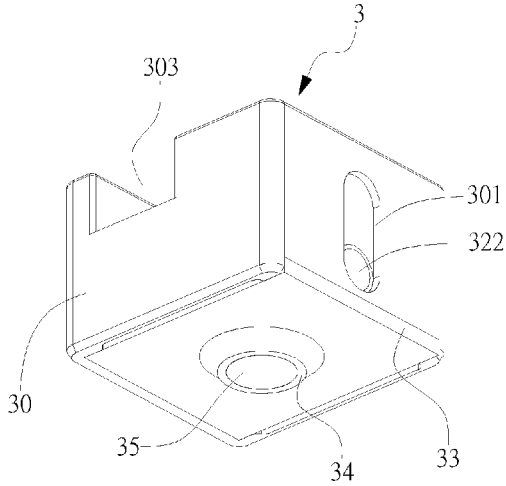

Please refer to FIG. 3A and FIG. 3B, which are three-dimensional views of the variable valve actuation mechanism of FIG. 2. As seen in FIG. 3A and FIG. 3B, the tappet 30 is designed with a contacting surface 302 formed at a top thereof that can be used for contacting to the low-lift cam 221. The accommodation space 303 of the tappet 30 is used for receiving the sliding block 31 while allowing the same to slide therein. Furthermore, groove holes 300, 301 are formed respectively on the two walls of the tappet 30 which are connected to the two hydraulic pipings 320, 323. The groove holes 300, 301 are both shaped as a trench that are used for introducing hydraulic pressures of the two hydraulic pipings 320, 323 to the sliding block 31 for forcing the same to move accordingly even when the tappet 30 is moving up and down the cylinder head 20.

As the sliding block 31 is moved and located under the contacting surface 302, the opening 3031 of the accommodation space 303 will not be blocked by the sliding block 31 and thus enable the rotating high-lift cam 220 to travel therethrough without contacting to any part of the tappet 30. In addition, a supporting panel 33 is fixedly arranged at the bottom of the tappet 30 for providing support to the sliding block 31 as the sliding block 31 is placed inside the accommodation space 303. It is noted that a circular recess 34 is formed at the bottom of the supporting panel 33, which is used for receiving at least a shim 35. By placing the shim 35 of various thicknesses, gaps caused by manufacture tolerance or assemble error can be filled. However, as there can be various methods for installing of the sliding block 31 into the tappet 30, the design of the supporting panel 33 can be varied or even changed completely, and thus the supporting of the sliding block 31 is not limited thereby.

Figure 4A:
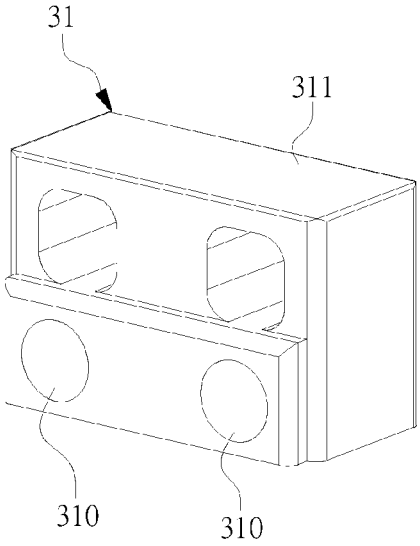
FIG. 4A and FIG. 4B are three-dimensional views of a sliding block used in the variable valve actuation mechanism of FIG. 2.
Figure 4B:
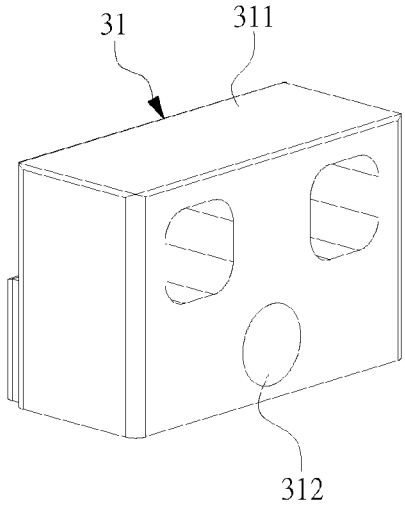
Figure 5A:
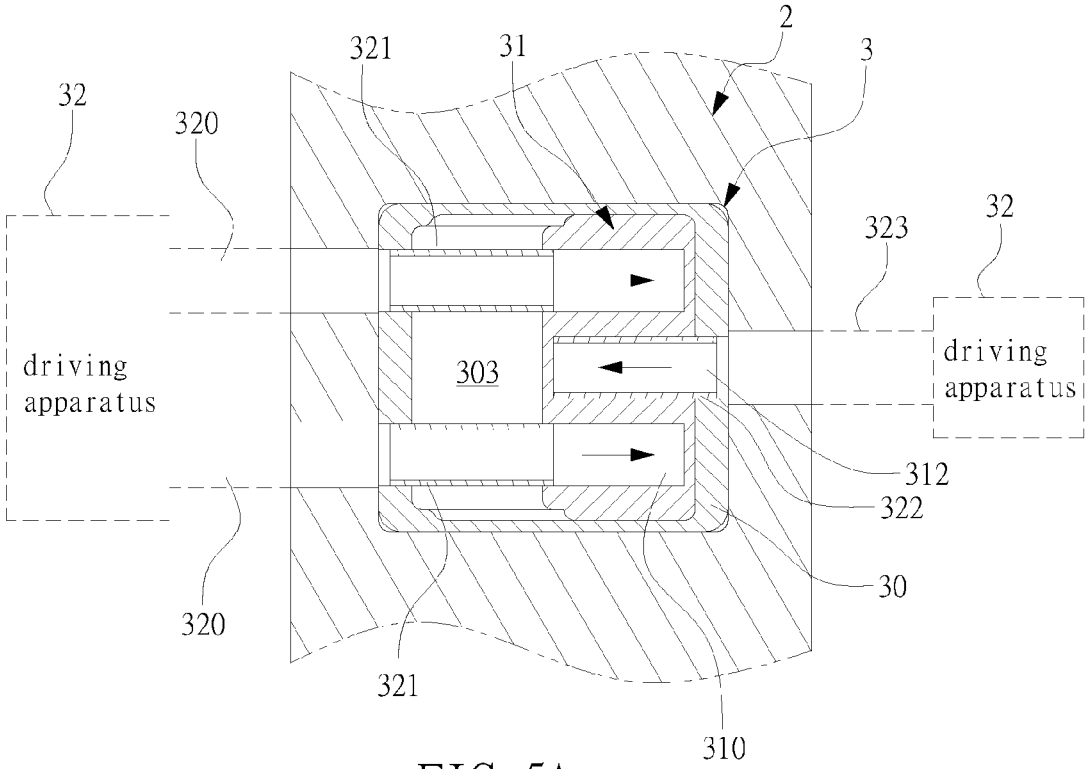
FIG. 5A is a top sectional view of FIG. 2.

Please refer to FIG. 4A, FIG. 4B and FIG. 5A, which are three-dimensional views of a sliding block used in the variable valve actuation mechanism of FIG. 2 and a top sectional view of FIG. 2. As seen in the figures, another contacting surface 311 is formed on top of the sliding block 31 while two first groove holes 310 are formed at a side of the sliding block 31. Each first groove hole 310 has a first hydraulic pressure sleeve 321 being received therein while enabling an end thereof to be fixedly connected to the tappet 30 for enabling the sliding block 31 to move slidably with respect to the first hydraulic pressure sleeve 321. Moreover, a second groove hole 312 is formed at a side of the sliding block 31 other than that of the first groove holes 310 that is used to receive a second hydraulic pressure sleeve 322, whereas an end of the second hydraulic pressure sleeve 322 is fixedly connected to the tappet 30 for enabling the sliding block 31 to move slidably with respect to the second hydraulic pressure sleeve 322. By the cooperative action of the first and the second hydraulic pressure sleeves 321, 322, not only the sealing of hydraulic activation corresponding to the sliding of the sliding block 31 can be maintained, but also it can prevent the sliding block 31 from escaping the confinement of the tappet 30 as it is moved to a position corresponding to the opening 3031 of the tappet 30. In addition, a hydraulic pressure is provided by the driving apparatus 32 which can be feed respectively to the first and the second hydraulic pressure sleeves 321, 322 through the two hydraulic pipings 320, 323, and thus the sliding block 31 can be forced to slide inside the accommodation space 303 of the tappet 30.

Figure 5B:
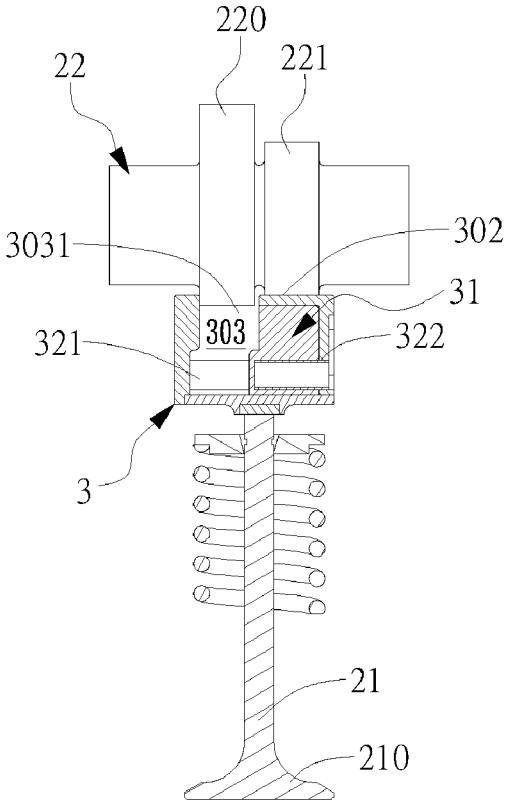
FIG. 5B and FIG. 5C are schematic diagrams cooperatively showing the variable valve actuation mechanism of FIG. 2 in action.
Figure 5C:
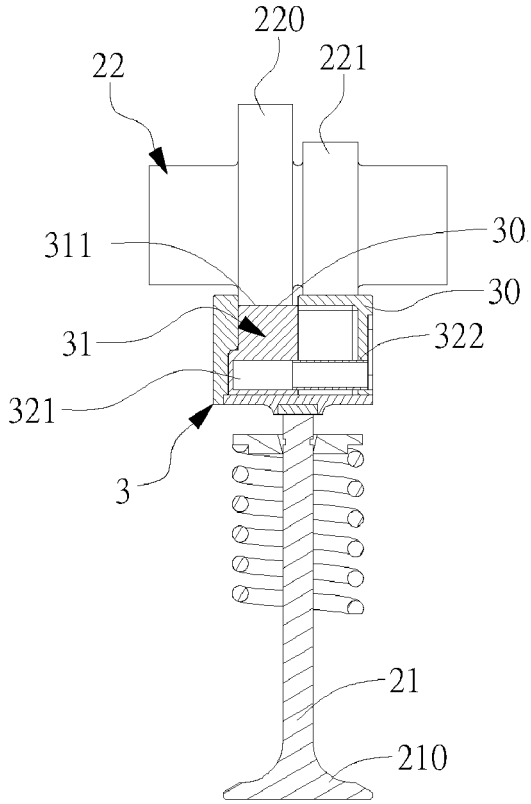

Please refer to FIG. 5B and FIG. 5C, which are schematic diagrams cooperatively showing the variable valve actuation mechanism of FIG. 2 in action. As seen in FIG. 5B that the valve of the engine is enabled with a low lift as the engine is first ignited or is performing at a low speed and the driving apparatus is providing a relatively low hydraulic pressure, the hydraulic pressure is fed to the first hydraulic pressure sleeve 321 and thus the sliding block 31 is forced to slide to the right for positioning the sliding block 31 under the contacting surface 302 of the tappet 30, by which only the contacting surface 302 is enabled to have contact with the low-lift cam 221 and thus, the valve lever 21 is pushed and thus the valve 21 is opened accordingly as the low-lift cam 221 of the actuating part 22 is rotating and pressing upon the tappet 30. At the same time, as the sliding block 31 is pushed to position under the contacting surface 302 of the tappet 30, the opening 3031 of the accommodation space 303 is not blocked by the sliding block 31 that enables the rotating high-lift cam 220 to travel therethrough without contacting to any part of the tappet 30.

As seen in FIG. 5C that the valve of the engine is required to be enabled with a high lift for improving the intake efficiency of the engine and thus enhancing output power as the engine is performing at a high speed, the hydraulic pressure is fed to the second hydraulic pressure sleeve 322 and thus the sliding block 31 is forced to slide to the left for positioning the sliding block 31 to block the opening 3031 and thus enabling the contacting surface 311 of the sliding block 31 to be placed directly under the high-lift cam 220. Thereby, as the cam lobe of the high-lift cam 220 is larger than that of the low-lift cam 221, only the contacting surface 311 of the sliding block 31 will be pressed by the rotating high-lift cam 220 for enabling the valve 210 with a corresponding high lift.

Figure 6:
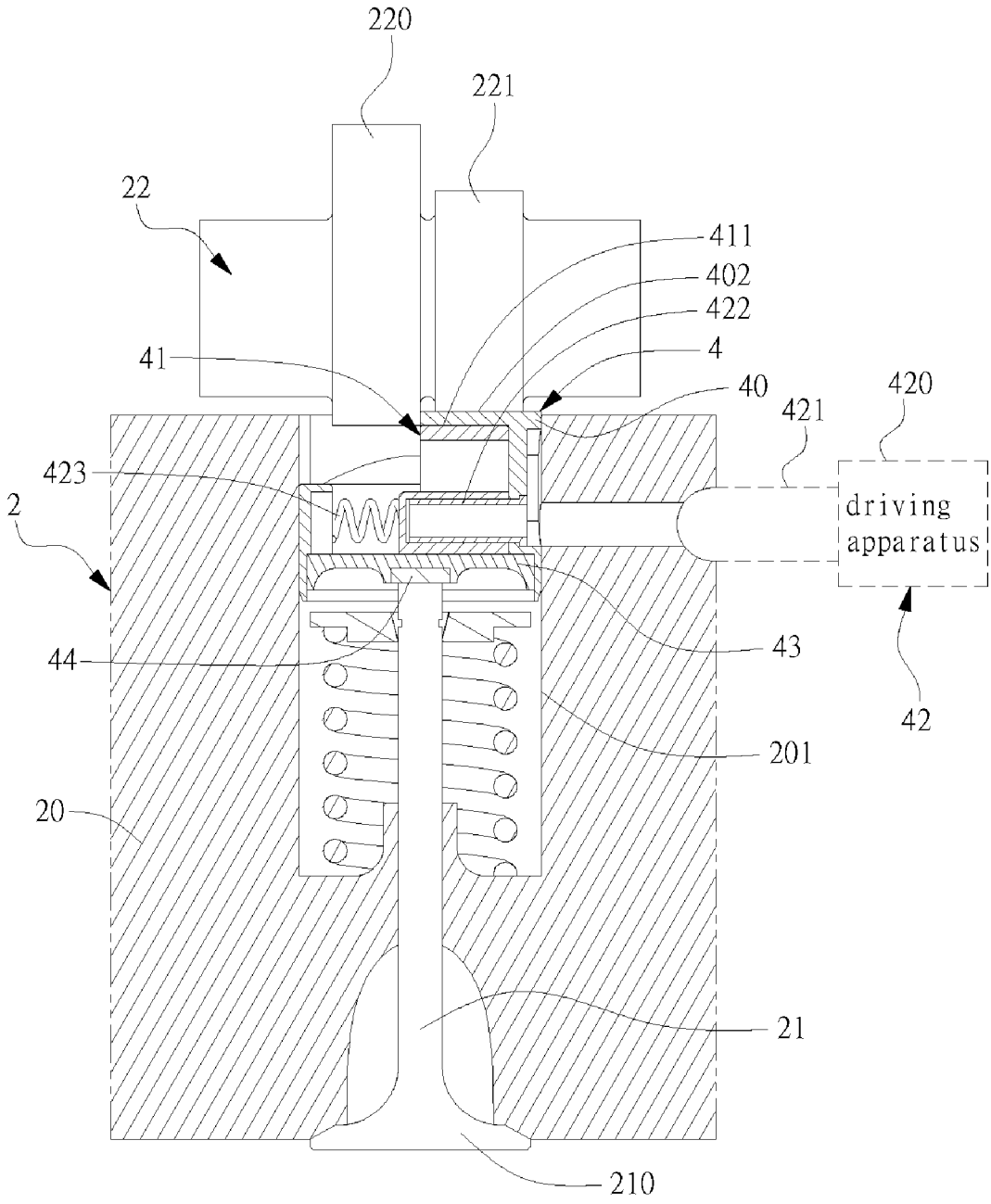
FIG. 6 is a cross-sectional diagram illustrating a variable valve actuation mechanism according to a second preferred embodiment of the invention as it is coupled to an engine.

Please refer to FIG. 6, which is a cross-sectional diagram illustrating a variable valve actuation mechanism according to a second preferred embodiment of the invention as it is coupled to an engine. The structure of the variable valve actuation mechanism 4 of FIG. 6 is similar to that of the first preferred embodiment that it is comprised of a tappet 40, a sliding block 41 and a driving apparatus 42. However, they are different in that the slicking block 41 is driven by spring and hydraulic means. Please refer to FIG. 7A and FIG. 7B, which are three-dimensional views of the variable valve actuation mechanism of FIG. 6. The tappet 40 is shaped as a column having a contacting surface 402 formed at the top thereof and an accommodation space 403 formed therein. Moreover, at a position of the top of the tappet 40 next to the contacting surface 402, an opening 4031 is formed that is channeling with the accommodation space 403. In addition, a groove hole 401 is formed at a side of the tappet 40 that can be used for enabling a hydraulic pressure to be provided to the sliding block 41 continuously while the variable valve actuation mechanism is actuated to move up and down. Preferably, a supporting panel 43 is fixedly arranged at the bottom of the tappet 40 for providing support to the sliding block 41 as the sliding block 41 is placed inside the accommodation space 403. It is noted that at least a shim 44 can be placed at the bottom of the supporting panel 43, by which gaps caused by manufacture tolerance or assemble error can be filled. However, as there can be various methods for installing of the sliding block 31 into the tappet 30, the design of the supporting panel 43 can be varied or even changed completely, and thus the supporting of the sliding block 41 is not limited thereby.

As it is required to maintain and feed a hydraulic pressure to the variable valve actuation mechanism 4, an anti-rotation device 45 is arranged at a side of the tappet 40 for preventing the same from rotating. The anti-rotation device 45 is substantially a knot 451 embedded inside a recess 450 formed at a side of the tappet 40. In this preferred embodiment, the knot is a roller, however, it can be a block.

Figure 8A:
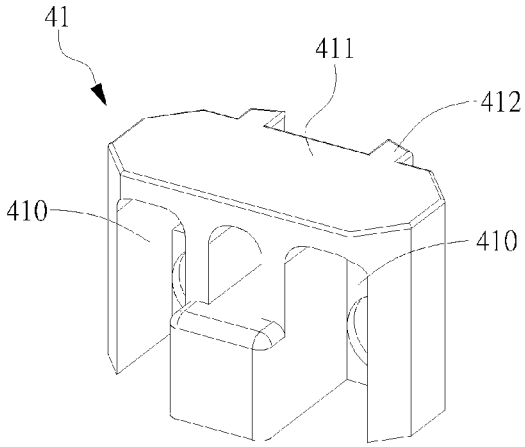
FIG. 8A and FIG. 8B are three-dimensional views of a sliding block used in the variable valve actuation mechanism of FIG. 6.
Figure 8B:
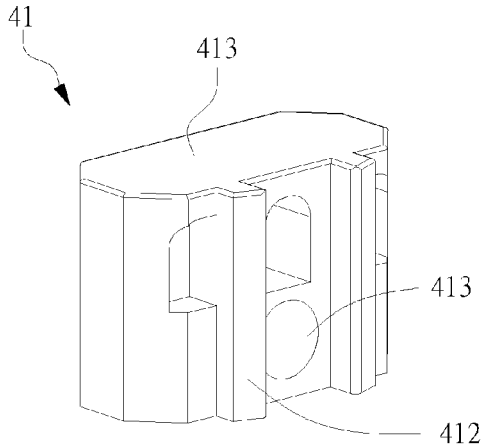

Please refer to FIG. 8A and FIG. 8B, are three-dimensional views of a sliding block used in the variable valve actuation mechanism of FIG. 6. As seen in the figures, the sliding block has a contacting surface 411 and two recesses 410 while a first groove hole 413 and at least a rib 412 is formed at a side thereof. In addition, the driving apparatus 42 is further comprised of: a first hydraulic pressure sleeve 422, being fitted inside the first groove hole 413 for enabling the sliding block to move slidably with respect to the first hydraulic pressure sleeve 422; a hydraulic part 420, connected to the first hydraulic pressure sleeve 422 by a hydraulic piping 421 for providing a hydraulic pressure to the first hydraulic pressure sleeve 422 and thereby forcing the sliding block 41 to move accordingly; and two elastic members 423, each being arranged for enabling an end thereof to abut against one recess 410 of the sliding block 41 while enabling another end thereof to abut against a wall of the tappet 40. In this preferred embodiment, each elastic member 423 is a spring.

Figure 7A:
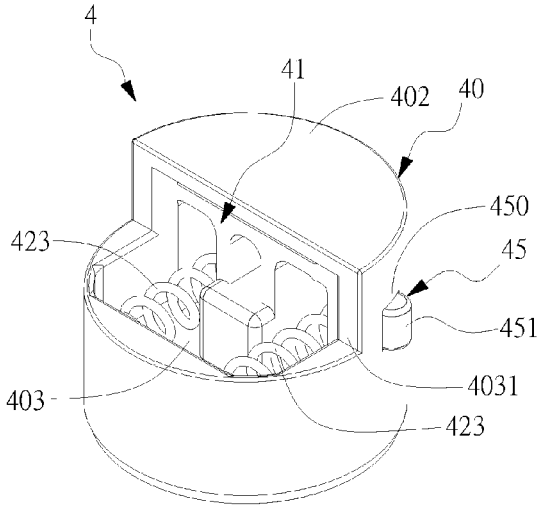
FIG. 7A and FIG. 7B are three-dimensional views of the variable valve actuation mechanism of FIG. 6.
Figure 7B:
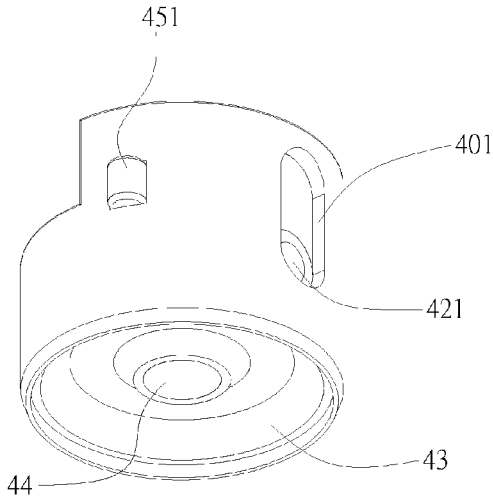

As seen in FIG. 7A and FIG. 8B, the rib 412 is used for preventing the sliding block 41 from escaping out of the accommodation space 403 of the tappet 40 through the opening 4031. In FIG. 6, as the first hydraulic pressure sleeve 422 is place on a level the same as that of spring 423 and as the sliding block 41 is required to be able to move within the tappet 40, the contacting surface 411 of the sliding block 41 should be designed at a level lower than that of the contacting surface 402 of the tappet 40, so that the lobe of the high-lift cam 220 should be larger than that of the low-lift cam 211 in correspondence.

Figure 9A:
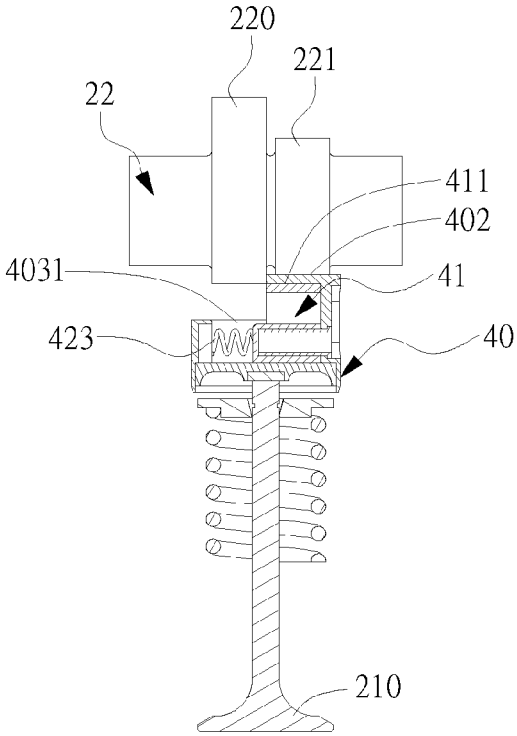
FIG. 9A and FIG. 9B are schematic diagrams cooperatively showing the variable valve actuation mechanism of FIG. 6 in action.
Figure 9B:
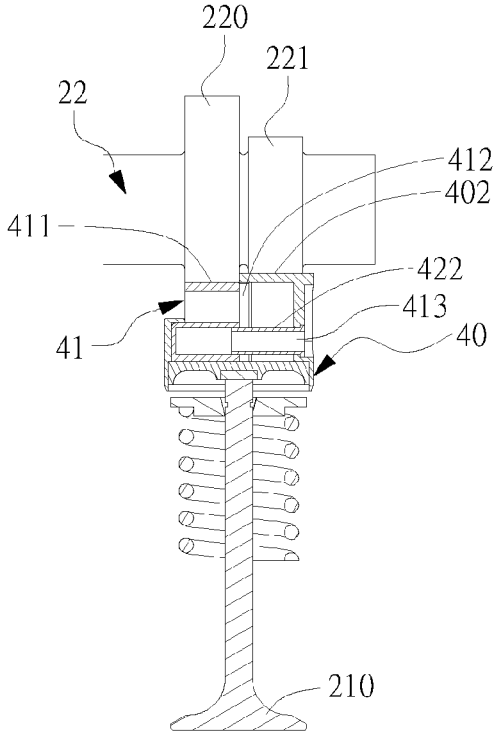

Please refer to FIG. 9A and FIG. 9B, which are schematic diagrams cooperatively showing the variable valve actuation mechanism of FIG. 6 in action. As seen in FIG. 9A that the valve of the engine is enabled with a low lift as the engine is performing at a low speed and the driving apparatus is not activated, the sliding block 41 is forced by the spring 423 to slide to the right, by which only the contacting surface 402 of the tappet 40 is enabled to have contact with the low-lift cam 221 and thus the valve 21 is opened accordingly as the low-lift cam 221 of the actuating part 22 is rotating and pressing upon the contacting surface 423 of the tappet 40. At the same time, as the opening 4031 of the accommodation space 403 is not blocked by the sliding block 41, the rotating high-lift cam 220 will travel therethrough without contacting to any part of the tappet 40.

As seen in FIG. 9B that the valve of the engine is required to be enabled with a high lift for improving the intake efficiency of the engine and thus enhancing output power as the engine is performing at a high speed, a hydraulic pressure is fed to the first hydraulic pressure sleeve 422 through the hydraulic piping and enter the first groove hole 413 for forcing the sliding block 41 to slide to the leftmost of the accommodation space 403 against the resist of the spring 423. When the sliding block 41 is positioned at the leftmost of the accommodation space 423, the rib 412 is located under the contacting surface 402 of the tappet 40 so that the sliding block 41 remains being received inside the accommodation space 403. Thereby, the contacting surface 411 of the sliding block 41 is placed directly under the high-lift cam 220 so that as the rotating high-lift cam 220 is pressing on the sliding block 41, the tappet 40 will lift the valve 210 for enabling the same with a corresponding high lift.

Figure 10:
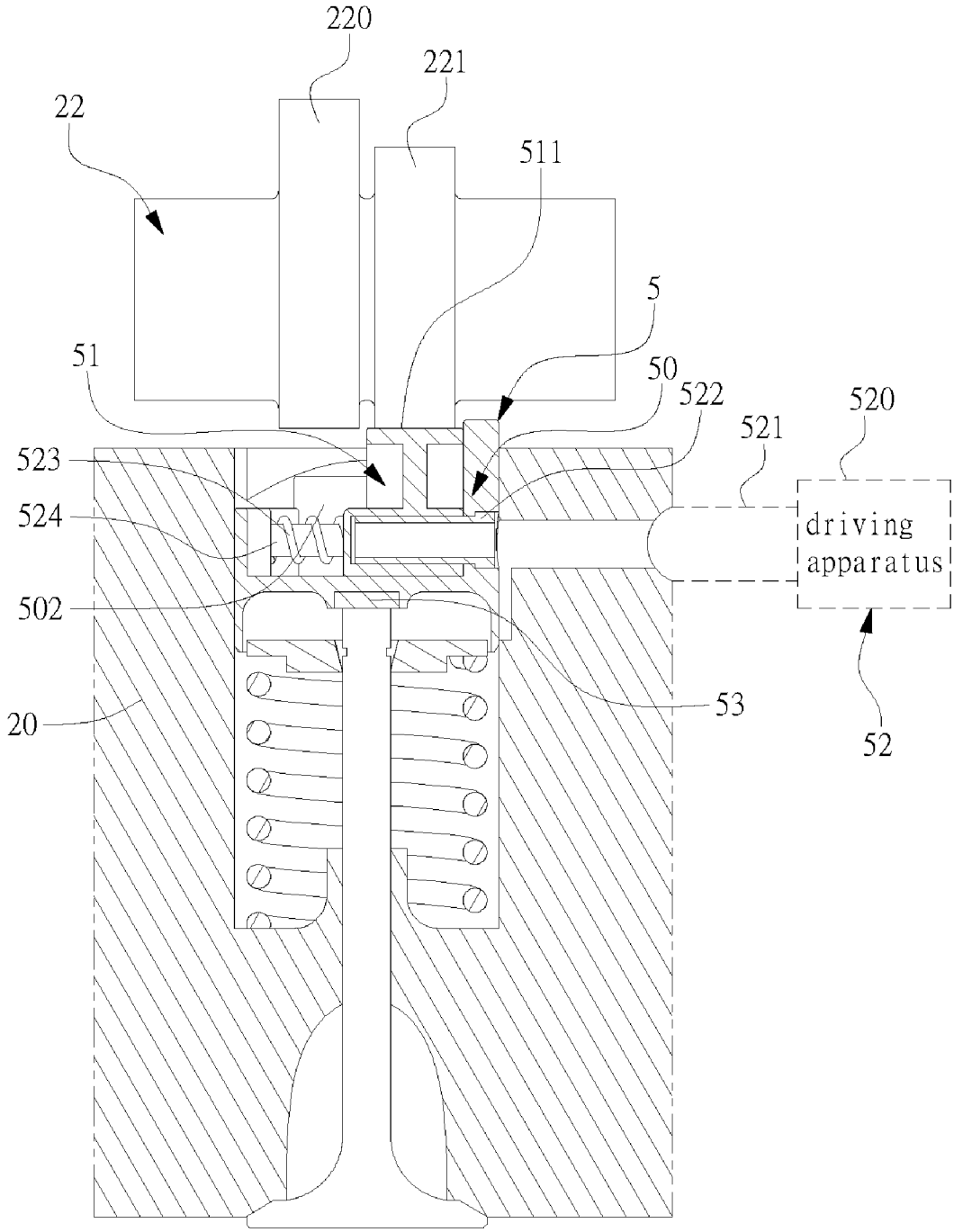
FIG. 10 is a cross-sectional diagram illustrating a variable valve actuation mechanism according to a third preferred embodiment of the invention as it is coupled to an engine.

Please refer to FIG. 10, is a cross-sectional diagram illustrating a variable valve actuation mechanism according to a third preferred embodiment of the invention as it is coupled to an engine. The structure of the variable valve actuation mechanism 5 of FIG. 10 is similar to those of the first and the second preferred embodiments that it is comprised of: a tappet 50 having an accommodation space 502 formed therein; a sliding block 51, being received inside the accommodation space 502; and a driving apparatus 52. However, the present embodiment is different in that the tappet 50 is designed with no contacting surface capable of contacting to the actuating part 22. In this preferred embodiment, it is the positioning of the sliding block 51 that control the receiving of the driving force of the actuating part 22 and thus controlling the actuating of the variable valve actuation mechanism 5. That is, the driving apparatus 52 is able to selectively drive the sliding block 51 to move to a first position or a second position of the accommodation space 502, at which the driving force of the actuating part 22 can be received.

Figure 11A:
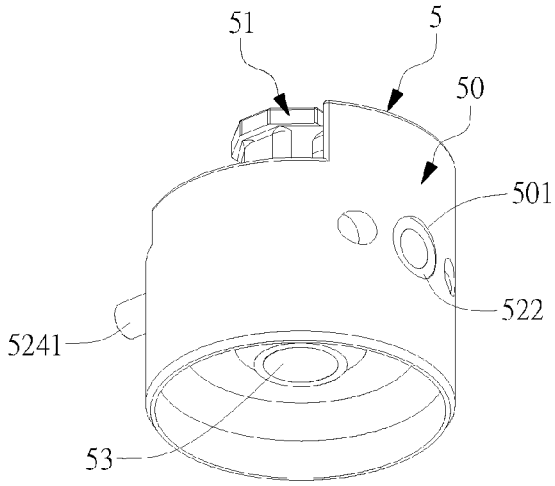
FIG. 11A and FIG. 11B are three-dimensional views of the variable valve actuation mechanism of FIG. 10.
Figure 11B:
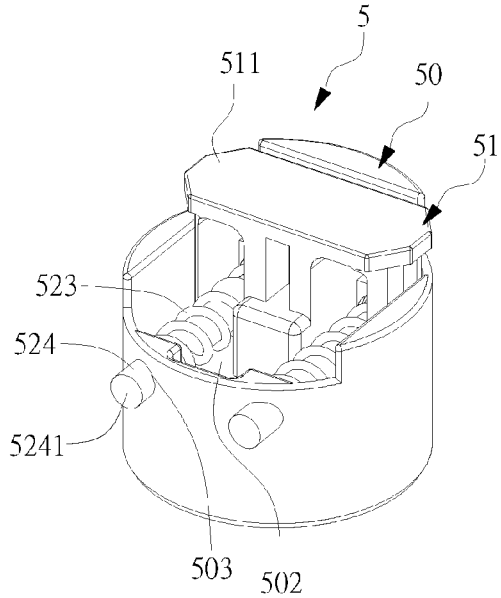

Please refer to FIG. 11A and FIG. 11B, which are three-dimensional views of the variable valve actuation mechanism of FIG. 10. As seen in the figures, the tappet 50 is designed with no contacting surface, i.e. the top of the accommodation space 502 is opened, which is comprised of: a groove hole, used for enabling a hydraulic pressure to feed therethrough while having a first hydraulic pressure sleeve 522 fitted therein; and two through holes 503. Since the top of the accommodation space 502 is opened, the supporting panel, similar to those used in the first and the second embodiments, can be integrally formed with the tappet 50 while enabling the shim to be arranged at the bottom thereof.

Figure 12A:
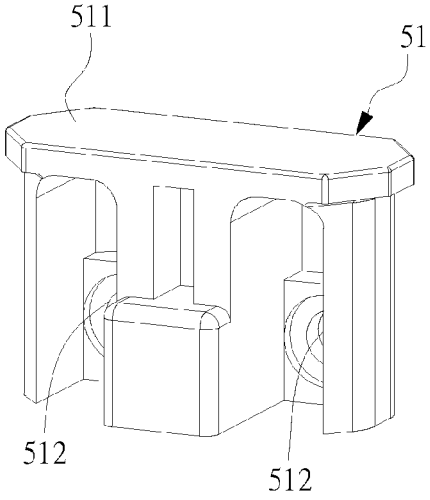
FIG. 12A and FIG. 12B are three-dimensional views of a sliding block used in the variable valve actuation mechanism of FIG. 10.
Figure 12B:
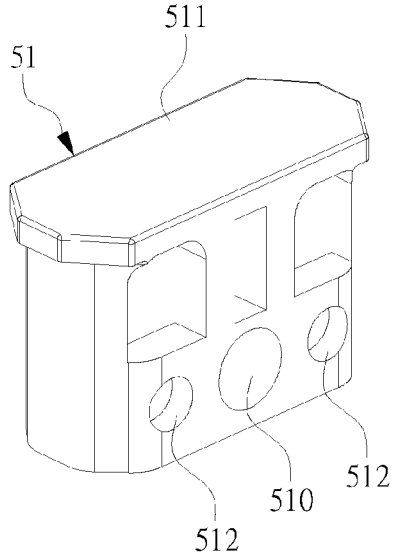

Please refer to FIG. 12A and FIG. 12B, are three-dimensional views of a sliding block used in the variable valve actuation mechanism of FIG. 10. The sliding block 51 is designed with a contacting surface 511 formed at the top thereof while having two via holes 512 boring therethrough. In addition, the sliding block 51 further has a first groove hole 510 connected to the first hydraulic pressure sleeve 522 in a manner that the sliding block is capable of sliding with respect to the first hydraulic pressure sleeve 522. As the first hydraulic pressure sleeve 522 is acting similar to those of foregoing embodiments and thus is not described further herein.

As seen in FIG. 10, FIG. 11A and FIG. 11B, the driving apparatus 52 is comprised of a hydraulic part 520, two elastic members 523 and two limiting shafts 524. The hydraulic part 520 is connected to the first hydraulic pressure sleeve 522 by a hydraulic piping 521, that is used for providing a hydraulic pressure to the first hydraulic pressure sleeve 522 and thus forcing the sliding block 51 to move accordingly. Each elastic member 523 is abutted against a side of the sliding block 51 by an end thereof while enabling another end thereof to abut upon a wall of the tappet 50. In this preferred embodiment, each elastic member 523 is a spring. Each limiting shaft 524 is surrounded by one elastic member 523 and piecing through one via hole 512 while enabling the two ends thereof to be fixedly connected to two walls of the tappet 50 in respective, in which one of the two end is extending out of its corresponding through hole 503 where an extruding part 5241 is formed bulging outside the wall of the tappet 50. As the extruding part 5241 is bulging outside the wall of the tappet 50, the rotation of the tappet 50 can be prevented. However, it is required to form two milled recesses on the cylinder head 20 for accommodating the corresponding extruding parts 5241. It is noted that the first hydraulic pressure sleeve 522 is place on a level the same as that of the two elastic members 523. As the two limiting shafts 524 are surrounded by the two elastic members 523 while piecing through the two via holes 512 of the sliding block 51 in respective, the movement of the sliding block is restricted by the two limiting shafts 524 so that the sliding block 51 is prevented from escaping out of the accommodation space 502 of the tappet 50.

Figure 13A:
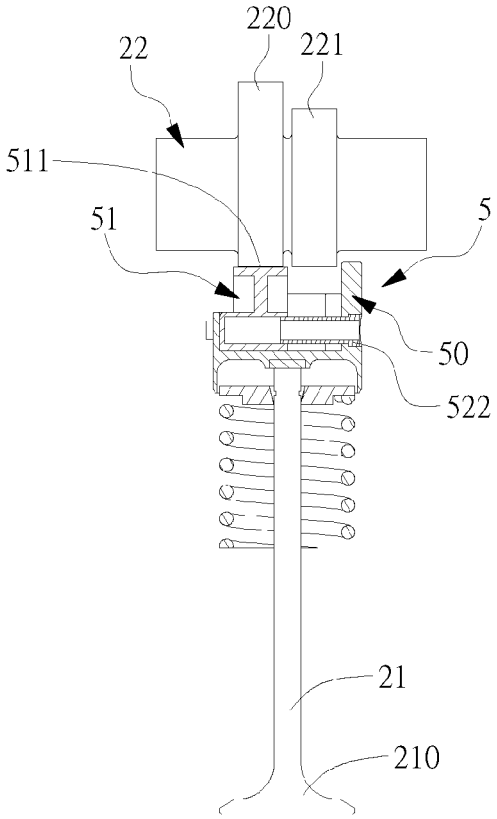
FIG. 13A and FIG. 13B are schematic diagrams cooperatively showing the variable valve actuation mechanism of FIG. 10 in action.
Figure 13B:
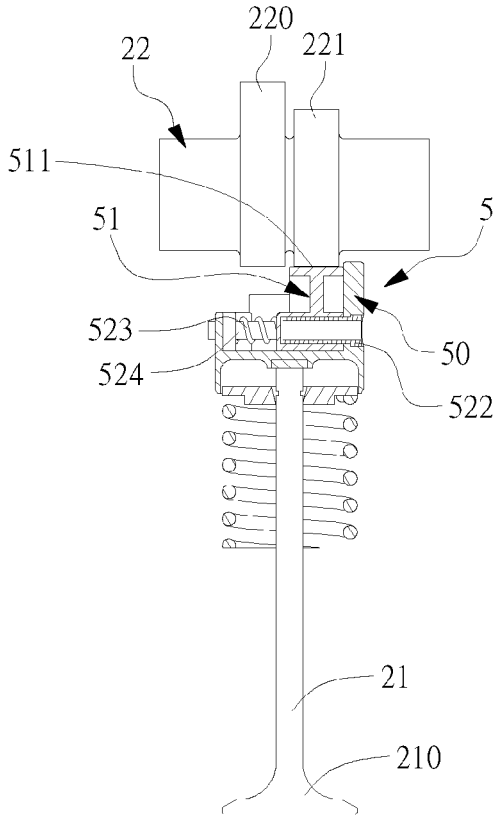

Please refer to FIG. 13A and FIG. 13B, which are schematic diagrams cooperatively showing the variable valve actuation mechanism of FIG. 10 in action. The operation of the variable valve actuation mechanism 5 of the preferred embodiment is similar to those aforesaid embodiments, but is different in that: the variable valve actuation mechanism 5 has only one contacting surface 511 that is formed on top of the sliding block 51 and can be move to different positions for enabling the same to have contact with either the high-lift cam 220 or the low-lift cam 221. As the lift control is realized by positioning the sliding block 51 at different positions, the lobes of the high-lift and low-lift cams 220, 221 can be the same that is different to those used in the first and the second preferred embodiments since in those two embodiments, the contacting surface of the tappet and that of the sliding block are separated by a drop.

Figure 14:
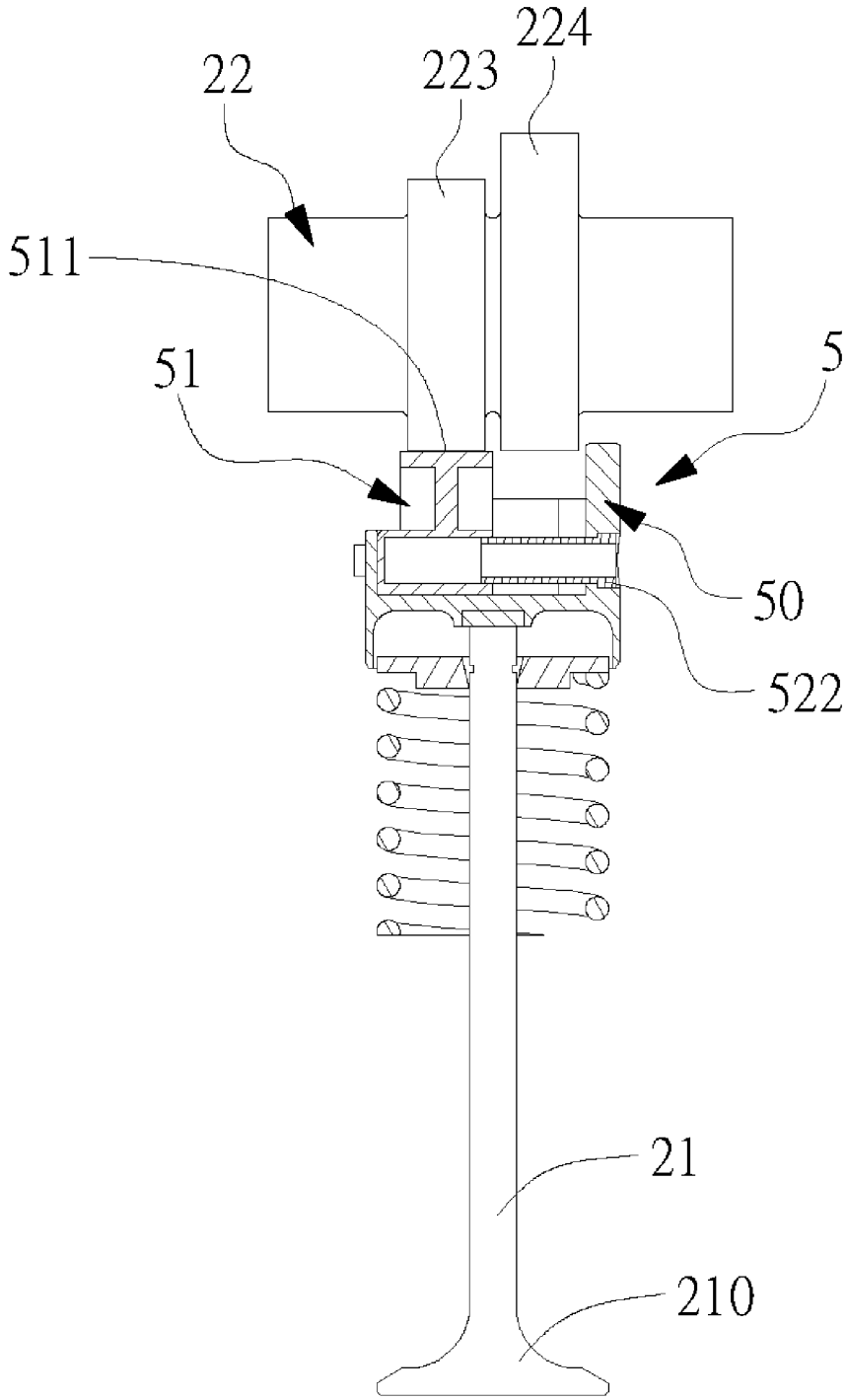
FIG. 14 shows the variable valve actuation mechanism of FIG. 10 enabling the engine to situate in cylinder deactivation status.

It is noted that the variable valve actuation mechanism not only is capable of valve lift control, but it is also suitable to be applied for controlling valves for enabling the corresponding cylinder to be situated in a deactivation status. Please refer to FIG. 14, which shows the variable valve actuation mechanism of FIG. 10 enabling the engine to situate in cylinder deactivation status. The structure of the variable valve actuation mechanism is unchanged, but the arrangement of the actuating part 22 is changed that the low-lift cam is replaced and substituted by a high-lift cam 224 while the high-lift cam is replaced and substituted by a disc 223. Operationally, as the engine is first ignited, the sliding block 51 is pushed and move to a position right under the high-lift cam by the elastic member 523 where it is pressed by the high-lift cam 224 and thus valves are enabled accordingly. However, when it is intended to deactivate the cylinder, the hydraulic part is actuated for pushing the sliding block 51 to the left for enabling the contacting surface 511 thereof to be positioned directly under the disc 223 where it is not pressed by the disc and thus the valves are not enabled.

To sum up, the present invention discloses a variable valve actuation mechanism, characterized in that movement of a sliding block is controlled for selectively receiving a driving force exerted from an actuating mechanism so as to control lift, such as higher or lower lift, of valves disposed in a combustion engine. With the design disclosed in the present invention, a conventional problem due to misalignment of the channel for pin sliding during changing lift of valve is capable of being solved. In the preferred embodiment of the present invention, actuating parts for controlling higher valve lift will not contact with the variable valve actuation mechanism while the valve is under lower lift so that the combustion engine will be operated in an appropriate rotation speed efficiently so as to reduce fuel consumption.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A variable valve actuation mechanism, comprising:

a tappet, having an accommodation space formed therein;

a sliding block, arranged inside the accommodation space, and a driving apparatus, for driving the sliding block to slide inside the accommodation space and thus enabling a part selected from the group consisting of the tappet and the sliding block to be selected for receiving a driving force and moved accordingly;

wherein said sliding block further comprising:

at least a first groove hole, formed at a side of the sliding block;

at least a first hydraulic pressure sleeve, each being fitted inside the at least one first groove hole while enabling an end thereof to be fixedly connected to the tappet for enabling the sliding block to move slidably with respect to the first hydraulic pressure sleeve while being driven to move by the driving apparatus;

at least a second groove hole, formed at a side of the sliding block other than that of the first groove hole; and at least a second hydraulic pressure sleeve, each being fitted inside the at least one second groove hole while enabling an end thereof to be fixedly connected to the tappet for enabling the sliding block to move slidably with respect to the second hydraulic pressure sleeve while being driven to move by the driving apparatus.

2. The variable valve actuation mechanism of claim 1, wherein the driving apparatus, substantially being a hydraulic pressure supplier, is connected respectively to the at least one first and second hydraulic pressure sleeves for enabling the same to provide a hydraulic pressure to a part selected from the group consisting of the at least one first hydraulic pressure sleeve and the at least one second hydraulic pressure sleeve, and thus enabling the selected part to be used for forcing the sliding block to move accordingly.

3. A variable valve actuation mechanism comprising:

a tappet, having an accommodation space formed therein;

a sliding block, arranged inside the accommodation space, and a driving apparatus, for driving the sliding block to slide inside the accommodation space and thus enabling a part selected from the group consisting of the tappet and the sliding block to be selected for receiving a driving force and moved accordingly;

wherein said sliding block further comprising:

at least a first groove hole, formed at a side of the sliding block;

at least a first hydraulic pressure sleeve, each being fitted inside the at least one first groove hole while enabling an end thereof to be fixedly connected to the tappet for enabling the sliding block to move slidably with respect to the first hydraulic pressure sleeve while being driven to move by the driving apparatus.

4. The variable valve actuation mechanism of claim 3, wherein the driving apparatus is further comprised of:

a hydraulic part, connected to the at least first hydraulic pressure sleeve for providing a hydraulic pressure to the first hydraulic pressure sleeve and thereby forcing the sliding block to move accordingly; and at least an elastic member, each being arranged for enabling an end thereof to abut against a side of the sliding block other than that of the first groove hole while enabling another end thereof to abut against a wall of the tappet.

5. The variable valve actuation mechanism of claim 3, wherein a knot is formed on an outer wall of the tappet.

6. The variable valve actuation mechanism of claim 3, wherein a first contacting surface is arranged at a top of the tappet while a second contacting surface is arranged at a top of the sliding block, and thereby enables the driving apparatus to selectively drive the sliding block to move to a position selected from the group consisting of: the position enabling the second contacting surface to be located under the first contacting surface so as to enable the driving force to be received by the first contacting surface, and any position enabling the driving force to be received by the second contacting surface directly.

7. The variable valve actuation mechanism of claim 3, wherein the driving force is provided by an actuating part and the actuating part is a cam set.

8. A variable valve actuation mechanism comprising:

a tappet, having an accommodation space formed therein;

a sliding block, arranged inside the accommodation space, and a driving apparatus, for driving the sliding block to slide inside the accommodation space and thus enabling a part selected from the group consisting of the tappet and the sliding block to be selected for receiving a driving force and moved accordingly;

wherein said sliding block further comprising:

at least a first groove hole, formed at a side of the sliding block;

at least a first hydraulic pressure sleeve, each being fitted inside the at least one first groove hole while enabling an end thereof to be fixedly connected to the tappet for enabling the sliding block to move slidably with respect to the first hydraulic pressure sleeve while being driven to move by the driving apparatus; and at least a via hole, boring through the sliding block.

9. The variable valve actuation mechanism of claim 8, wherein the driving apparatus is further comprised of:

a hydraulic part, connected to the at least first hydraulic pressure sleeve for providing a hydraulic pressure to the first hydraulic pressure sleeve and thereby forcing the sliding block to move accordingly;

at least an elastic member, each being arranged for enabling an end thereof to abut against a side of the sliding block other than that of the first groove hole while enabling another end thereof to abut against a wall of the tappet; and at least a limiting shaft, each being surrounded by the at least one elastic member and extending passing through the at least one via hole while enabling the two ends thereof to fixedly connected to two different walls of the tappet in respective.

10. The variable valve actuation mechanism of claim 9, a protruding part is extendedly formed at an end of the at least one limiting shaft while bulging outside the tappet.

11. A variable valve actuation mechanism, comprising:

a tappet, having an accommodation space formed therein;

a sliding block, arranged inside the accommodation space; and a driving apparatus, for driving the sliding block to slide inside the accommodation space and positioning the same at a position selected from a first position and a second position, where the sliding block is enabled to receive a driving force at the selected position of the driving apparatus and moved accordingly;

wherein the sliding block further comprises:

at least a first groove hole, formed at a side of the sliding block;

at least a first hydraulic pressure sleeve, each being fitted inside the at least one first groove hole while enabling an end thereof to be fixedly connected to the tappet for enabling the sliding block to move slidably with respect to the first hydraulic pressure sleeve while being driven to move by the driving apparatus;

at least a second groove hole, formed at a side of the sliding block other than that of the first groove hole; and at least a second hydraulic pressure sleeve, each being fitted inside the at least one second groove hole while enabling an end thereof to be fixedly connected to the tappet for enabling the sliding block to move slidably with respect to the second hydraulic pressure sleeve while being driven to move by the driving apparatus.

12. The variable valve actuation mechanism of claim 11, wherein the driving apparatus, being a hydraulic pressure supplier, is connected respectively to the at least one first and second hydraulic pressure sleeves for enabling the same to provide a hydraulic pressure to a part selected from the group consisting of the at least one first hydraulic pressure sleeve and the at least one second hydraulic pressure sleeve, and thus enabling the selected part to be used for forcing the sliding block to move accordingly.

13. The variable valve actuation mechanism of claim 11, wherein a knot is formed on an outer wall of the tappet.

14. A variable valve actuation mechanism comprising:

a tappet, having an accommodation space formed therein;

a sliding block, arranged inside the accommodation space; and a driving apparatus, for driving the sliding block to slide inside the accommodation space and positioning the same at a position selected from a first position and a second position, where the sliding block is enabled to receive a driving force at the selected position of the driving apparatus and moved accordingly;

wherein the sliding block further comprises:

at least a first groove hole, formed at a side of the sliding block;

at least a first hydraulic pressure sleeve, each being fitted inside the at least one first groove hole while enabling an end thereof to be fixedly connected to the tappet for enabling the sliding block to move slidably with respect to the first hydraulic pressure sleeve while being driven to move by the driving apparatus; and at least a via hole, boring through the sliding block.

15. The variable valve actuation mechanism of claim 14, wherein the driving apparatus is further comprised of:

a hydraulic part, connected to the at least first hydraulic pressure sleeve for providing a hydraulic pressure to the first hydraulic pressure sleeve and thereby forcing the sliding block to move accordingly;

at least an elastic member, each being arranged for enabling an end thereof to abut against a side of the sliding block other than that of the first groove hole while enabling another end thereof to abut against a wall of the tappet; and at least a limiting shaft, each being surrounded by the at least one elastic member and extending passing through the at least one via hole while enabling the two ends thereof to fixedly connected to two different walls of the tappet in respective.

16. The variable valve actuation mechanism of claim 15, wherein a protruding part is extendedly formed at an end of the at least one limiting shaft while bulging outside the tappet.

17. The variable valve actuation mechanism of claim 14, wherein the driving force is provided by an actuating part and the actuating part is a cam set.

* * * * *